US009871321B2

(12) United States Patent
Knorr

(10) Patent No.: US 9,871,321 B2
(45) Date of Patent: Jan. 16, 2018

(54) ELECTRICAL CONNECTION DEVICE

(71) Applicant: Multi-Holding AG, Allschwil (CH)

(72) Inventor: Thomas Knorr, Efringen-Kirchen (DE)

(73) Assignee: Multi-Holding AG, Allschwil (DE)

( * ) Notice: Subject to any disclaimer, the term of this patent is extended or adjusted under 35 U.S.C. 154(b) by 0 days.

(21) Appl. No.: 15/313,340

(22) PCT Filed: May 20, 2015

(86) PCT No.: PCT/EP2015/061115
§ 371 (c)(1),
(2) Date: Nov. 22, 2016

(87) PCT Pub. No.: WO2015/181021
PCT Pub. Date: Dec. 3, 2015

(65) Prior Publication Data

US 2017/0149173 A1 May 25, 2017

(30) Foreign Application Priority Data

May 28, 2014 (EP) ..... 14170300

(51) Int. Cl.
*H01R 24/28* (2011.01)
*H01R 13/629* (2006.01)
*H01R 105/00* (2006.01)

(52) U.S. Cl.
CPC ..... *H01R 13/629* (2013.01); *H01R 24/28* (2013.01); *H01R 2105/00* (2013.01)

(58) Field of Classification Search
CPC ..... H01R 2103/00; H01R 24/28; H01R 24/20
USPC ..... 439/694, 697, 686
See application file for complete search history.

(56) References Cited

U.S. PATENT DOCUMENTS 3,335,395 A * 8/1967 Smith ..... H01R 13/56 439/466
3,375,481 A * 3/1968 Parnell ..... H01R 31/00 439/466
3,950,069 A * 4/1976 Wiley ..... H01R 13/56 439/694
5,791,918 A 8/1998 Pierce
6,089,897 A * 7/2000 Boussairy ..... H01R 13/6275 439/157

(Continued)

FOREIGN PATENT DOCUMENTS

DE 29822350 U1 4/1999
EP 0942495 A1 9/1999
WO 9613081 A1 5/1996

*Primary Examiner* — Gary Paumen
(74) *Attorney, Agent, or Firm* — The Webb Law Firm

(57) ABSTRACT

An electrical connection device (1), especially in the form of a connecting box, comprises a housing (2) having a wall (4) delimiting an inner space (3), electrical components (5) arranged in said inner space (3) and having at least two connecting portions (6, 7, 8), and at least two connecting holes (9, 10, 11) passing through the wall (4), through which external elements (12) connectable to the connecting portions (6, 7, 8) can be guided into the inner space (3). The connection device (1) further comprises a mechanical safety element (13) having a number of stop elements (14, 15, 16) that corresponds to the number of connecting portions (6, 7, 8), which stop elements (14, 15, 16) provide a mechanical stop for the external elements (12).

46 Claims, 6 Drawing Sheets

(56) References Cited

U.S. PATENT DOCUMENTS 6,517,388 B1 * 2/2003 Croise ..... H01R 4/60
439/697
7,819,704 B1 * 10/2010 Su ..... H01R 24/28
439/131
8,851,933 B2 * 10/2014 Fosaaen ..... H01R 4/4818
439/660

* cited by examiner

ELECTRICAL CONNECTION DEVICE

CROSS-REFERENCE TO RELATED APPLICATIONS

This application is the United States national phase of International Application No. PCT/EP2015/061115 filed May 20, 2015, and claims priority to European Patent Application No. 14170300.9 filed May 28, 2014, the disclosures of which are hereby incorporated in their entirety by reference.

BACKGROUND OF THE INVENTION

Field of the Invention

The present invention relates to an electrical connection device, in particular a plug-in connector for connecting a plurality of external elements.

Description of Related Art

Electrical connection devices, in particular in the form of connecting boxes, are known from the prior art. Typically, such connecting boxes comprise inputs and outputs, via which cables are routed into or out of the connecting box. The inputs and the outputs function as interfaces in this case.

In many fields of the technology it is important that the cables are connected very simply yet securely to the connecting box. In robotics, for example, it is often necessary to replace the cables under a great deal of time pressure. At this time, no connecting boxes are known from the prior art, which would allow for a quick replacement of multiple cables.

SUMMARY OF THE INVENTION

Against this background, a problem addressed by the invention is that of providing an electrical connection device, in particular a connecting box having multiple interfaces, wherein the external elements, in particular cables, are connected within the shortest possible time yet securely to the connection device.

Such a problem is solved by an electrical connection device, in particular in the form of a connecting box or a plug-in connector, comprising a housing having a wall delimiting an inner chamber, electrical components arranged in the inner chamber and having at least two connecting portions, and at least two connecting openings passing through the wall, through which external elements connectable to the connecting portions can be routed into the inner chamber. The connection device further comprises a mechanical fastening element having a number of stop elements which corresponds to the number of connecting portions, which stop elements provide a mechanical stop for the external elements.

An external element is, for example, a plug having a cable which plug is supposed to be connected to the connecting portions within the housing.

Due to the fastening element which cooperates with multiple external elements simultaneously, the stop for all external elements can be eliminated by means of a single actuation and the external elements can be disconnected from the connecting portions. At the same time, the fastening element prevents an unintentional disconnection between the external elements and the connecting portions from taking place.

The connection device can be a plug-in connector or a connecting box, wherein at least one external element, in particular a plug having a cable, can be connected to the plug-in connector or to the connecting box via the connecting portions.

This is an advantage in many areas of application. For example, in production lines, it is possible, in this way, to electrically connect a new tool to a robot within a very short period of time.

The fastening element is preferably made from an electrically insulating material, such as a plastic. This results in the advantage that separate insulating measures become superfluous.

Preferably, all stop elements are situated on one shared fastening element. As a result, the stop for a plurality of external elements can be eliminated by actuation the one fastening element. This means that external elements connected to the connection device can be disconnected from the connection device by actuating the one fastening element. In other words, particularly preferably, exactly one single fastening element is provided.

Particularly preferably, said stop element is provided, in each case, by a stop surface on the fastening element, by means of which stop surface the stop can be provided for the external element when the external element is inserted. The stop surface can engage on the external element in a positively locking manner or in a force-fit manner in this case and thereby provide the stop.

In the positively locking manner design, the stop surface is preferably oriented transversely to the orientation of the connecting portion and, therefore, also transversely to the insertion direction of the external element.

Particularly preferably, the fastening element comprises at least two recesses, wherein each of the recesses is partially or completely enclosed by one stop surface, and wherein one of the external elements can be routed through a recess in each case, and wherein the stop surface is located behind the recess relative to the insertion direction of the external element.

Particularly preferably, the recess is an opening enclosed by the fastening element. The opening accommodates parts of the external element. Alternatively, the recess extends from the outside into the fastening element and has the shape of a slot.

Preferably, the connecting portions are essentially cylindrical and extend along a central axis. The fastening element is designed, in this case, to be movable transversely to this central axis. Preferably, the recess is designed to cylindrically enclose a central axis at least in sections or entirely. The recess therefore has a cylindrical region. The central axis of the cylindrical area extends parallel to the central axis of the connecting portion, wherein, in the fastening position, the central axes are offset with respect to each other. In the release position, the two central axes preferably extend collinear with respect to each other.

Preferably, the connecting portions are situated relative to the connecting opening in such a way that the central axis of the connecting portions extends collinear to the central axis of the connecting opening.

The inner width of the recess, as viewed in the direction of the central axis, is designed larger than the portion of the external element extending through the recess.

Particularly preferably, the recess comprises a chamfered edge. In this case, the chamfered edge is situated in such a way that the fastening element is automatically actuated when the external element is inserted. Alternatively or additionally, the external element comprises a chamfered edge which cooperates with the recess, in particular with its chamfered edge.

Preferably, the fastening element can be moved from a fastening position and into a release position, wherein the connection device further comprises a return element which holds the fastening element in the fastening position and with which the fastening element can be automatically moved from the release position and into the fastening position.

The fastening element lies essentially entirely in the inner chamber. As a result, the fastening element is protected against external influences. Preferably, parts of the fastening element can be operated from the outside, and so the fastening element can be moved into the release position.

Preferably, the fastening element comprises at least one actuating portion which is accessible from outside the inner chamber through an opening in the wall. The actuating portion can therefore be acted upon from outside the inner chamber with a force, and so the fastening element can be moved via the actuating portion from the fastening position and into the release position. Preferably, the actuating portion comprises a contact surface which is flush with the outer side of the housing in the fastening position.

Particularly preferably, a sealing element is situated between the wall, in the region of the opening, through which the actuating portion extends in or through, and the actuating portion. As a result, moisture is prevented from entering the connection device.

Particularly preferably, said sealing element is a flat gasket which is mounted on a shoulder on the actuating portion and, in the fastening position, is pressed against the corresponding housing wall.

In one embodiment, the fastening element is essentially bar-shaped and comprises webs which extend away from the fastening element and increase the stiffness of the fastening element. By means of the webs, mechanical twisting can be prevented.

The fastening element is mounted, so as to be movable relative to the housing, in a guide which is integrally formed on the housing or in a guide provided through the housing, wherein the guide lies in the inner chamber of the housing. The guide can be an integral component of the housing.

Particularly preferably, at least one of the side walls is designed as a cover provided separately from the housing. Advantageously, a seal is arranged between the cover and the housing.

The number of connecting openings advantageously corresponds to the number of connecting portions and/or the number of stop elements.

Preferably, each of the electrical elements comprises at least one further connecting portion in addition to said at least one connecting portion. The further connecting portion can have various shapes. In one possible embodiment as a plug-in connector, the further connecting portion forms the bushing side or the pin side of a plug which extends through the wall. In another embodiment, in which the connection device is designed as a connecting box, the further connecting portion can be in electrically conductive connection to electrical parts, such as a printed circuit board, in the inner chamber of the housing.

One arrangement comprises an electrical connecting device as described above and at least one external element to be connected to the electrical connection device, wherein the external element comprises a portion which cooperates with the stop element. Said portion and the stop element provide a, in particular, mechanical snap-in geometry.

In one particularly preferable embodiment, the external element is a plug portion comprising a cable which is electrically conductively connected to the plug portion. According to a first variant, the plug portion can be electrically conductively connected to the at least one connecting portion, wherein the plug portion is designed as a bushing and the connecting portion is designed as a pin. According to a second variant, the plug portion is designed as a pin and the connecting portion is designed as a bushing. In both variants, an electrical contact is established between the pin and the bushing, preferably via an interposed contact laminations.

Said portion which cooperates with the stop element is preferably a protuberance or a groove. Preferably, the protuberance is designed having a chamfered edge on its front side, which chamfered edge cooperates with the stop element during insertion and moves the fastening element from the fastening position and into the release position. The groove can extend either into the plug portion or can be provided by two protuberances, which are spaced from each other.

Preferably, the fastening element is movable transversely to the insertion direction and, in the fastening position, the stop elements are situated relative to the protuberance or the groove in such a way that a movement against the insertion direction is prevented.

In the fastening position, the stop elements lie in such a way that the central axis of the cylindrical or partially cylindrical region is offset with respect to the central axis of the plug portion, according to the description provided above. Due to this eccentric arrangement, the plug portion is held by the stop element or, as a result, the stop element can provide a stop which is formed with the groove or the protuberance.

Further embodiments are described in the dependent claims.

BRIEF DESCRIPTION OF THE DRAWINGS

Preferred embodiments of the invention are described in the following with reference to the drawings which are intended merely for the purpose of explanation and are not intended to be interpreted to be limiting. In the drawings.

DESCRIPTION OF THE INVENTION

Figure 1:
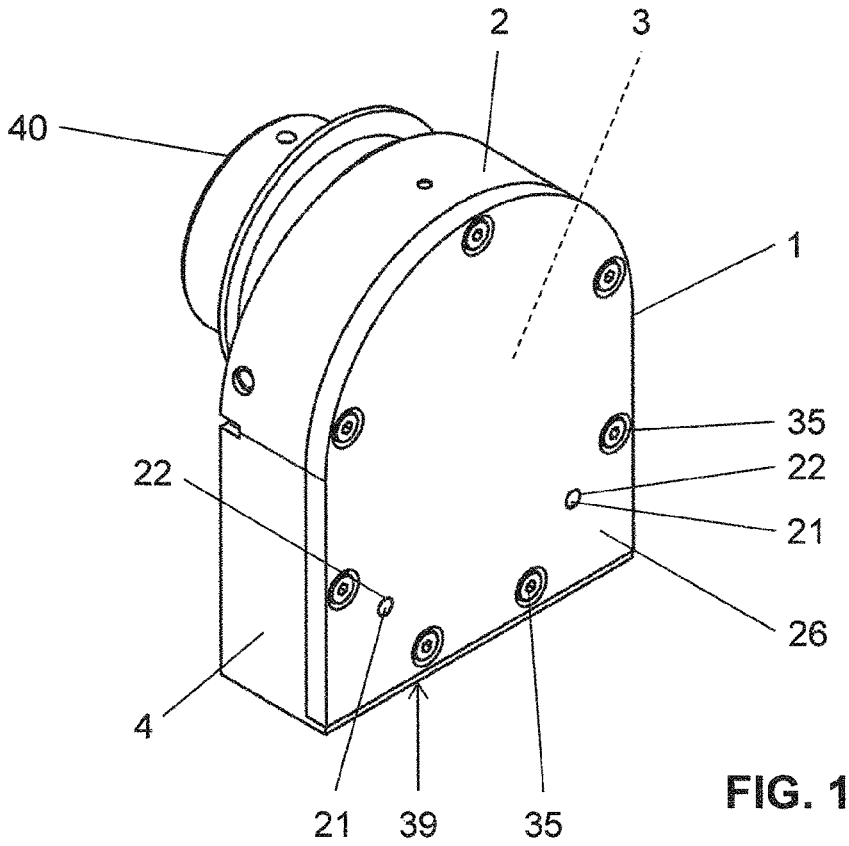
FIG. 1 shows a perspective front view of an electrical connection device.

An electrical connection device 1 according to one embodiment of the present invention is shown in FIGS. 1 to 5. The electrical connection device 1 is a connecting box, in particular, which is used for distributing electrical energy and/or control signals.

In the embodiment shown, the connection device 1 comprises an input side 39, via which a cable can be inserted into the connection device 1, and an output side 40 having a connector face having three plugs 29. Via the output side 40, the connection device 1 can be connected to a matching plug. The connection device 1 can also have a different design, however, as the following description shows.

The electrical connection device 1 comprises a housing 2 having a wall 4 which delimits an inner chamber 3. In the inner chamber 3, the electrical connection device 1 comprises electrical components 5 having at least two—three, in this case—connecting portions 6, 7 and 8. The electrical components 5 are situated entirely in the inner chamber 3 in this case. The electrical connecting portions 6, 7 and 8 are used for contacting an external element 12, such as, for example, a cable having a plug. In addition, at least two—three, in this case—connection openings 9, 10 and 11 extending through the wall 4 are present, through which openings the external elements 12 to be connected to the connecting portions 6, 7 and 8 can be routed into the inner chamber 3. The number of connection openings 9, and 11 corresponds to the number of connecting portions 6, 7 and 8.

Figure 3:
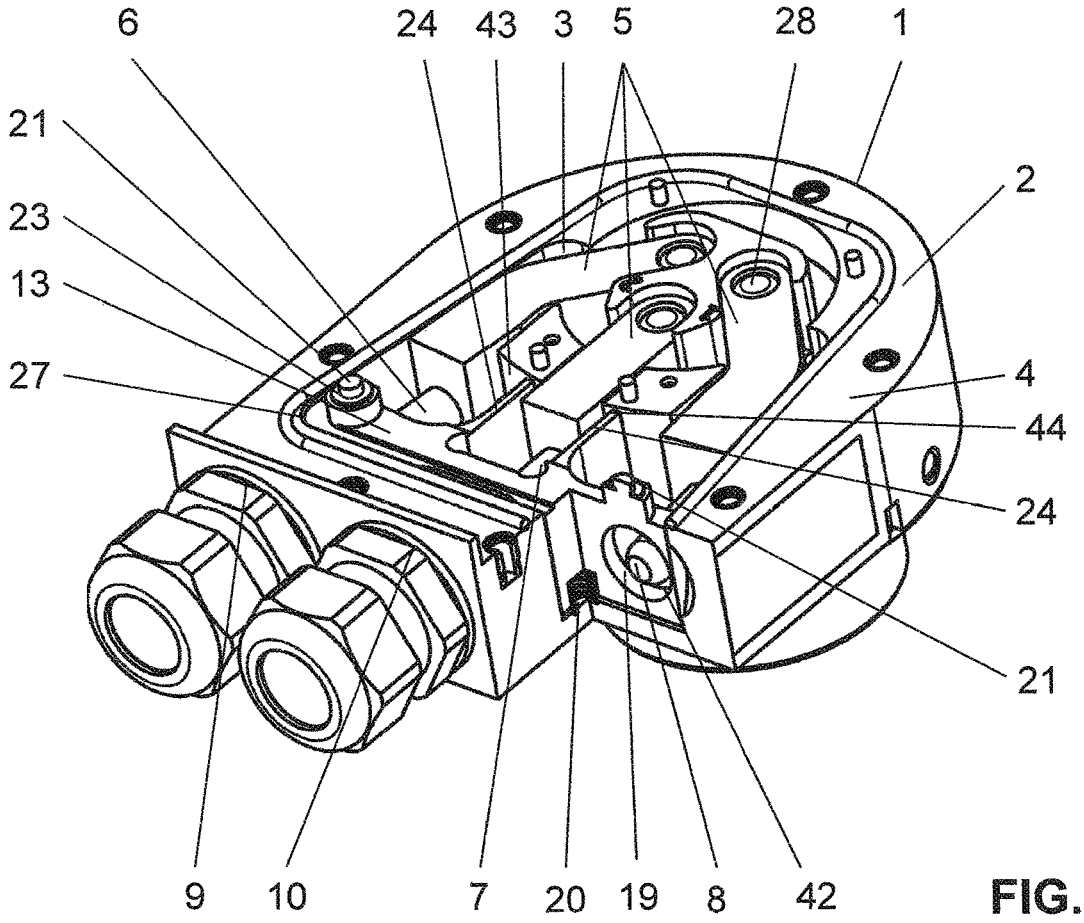
FIG. 3 shows a perspective view having partially cutaway passages of the electrical connection device according to FIG. 1.
Figure 4:
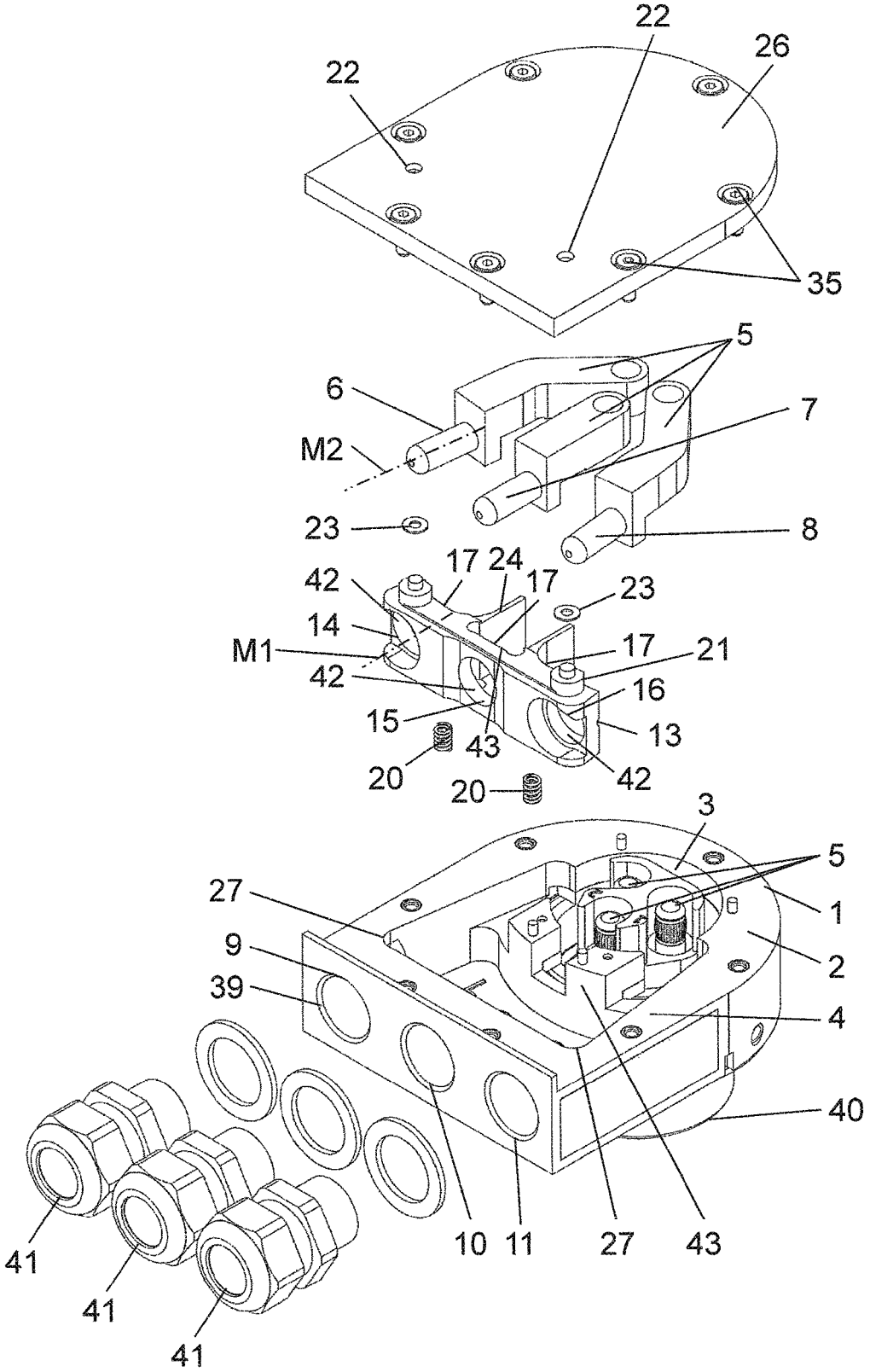
FIG. 4 shows an exploded representation of the connection device according to one of the preceding figures.

The connection device 1 also comprises a mechanical fastening element 13 which is shown in FIGS. 3 and 4. The mechanical fastening element 13 comprises at least two—three, in this case—stop elements 14, 15 and 16. The number of stop elements 14, 15 and 16 corresponds to the number of connecting portions 6, 7 and 8 or to the number of connection openings 9, 10, 11. The stop elements 14, 15 and 16 provide a mechanical stop for the external elements 12. The stop for the external elements 12 functions in such a way that the external elements 12 cannot be disconnected from the connecting portions 6, 7 and 8 without the actuation of the fastening element 13. The fastening element 13 must be actuated in order to disconnect the external elements 12 from the connecting portions 6, 7 and 8. Due to the arrangement of all stop elements 14, 15 and 16 on said fastening element 13, all external elements 12 are released essentially simultaneously.

Figure 2:
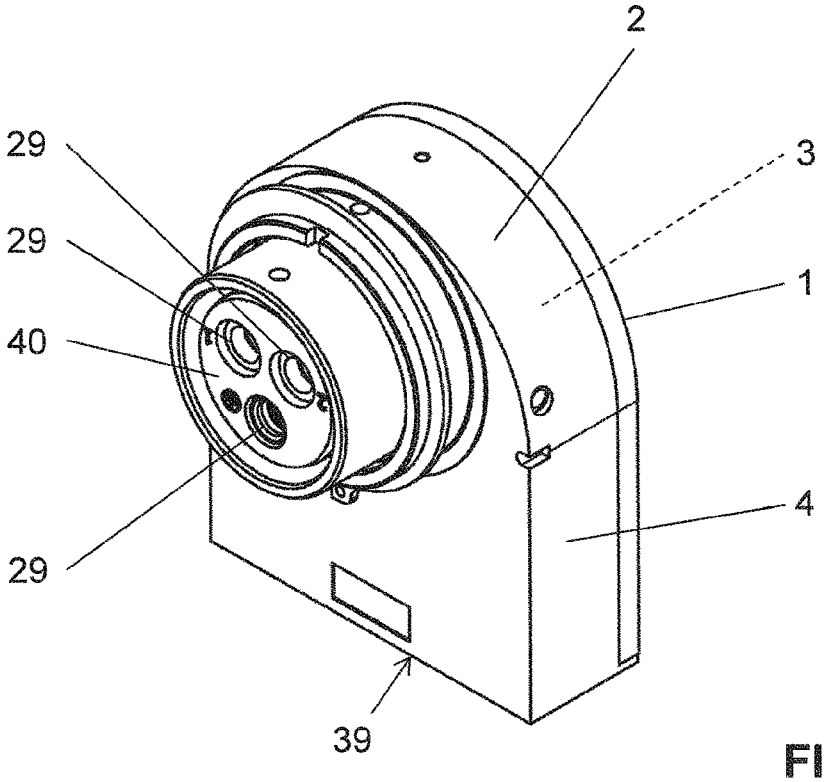
FIG. 2 shows a perspective rear view of the electrical connection device according to FIG. 1.

The housing 2 comprises a cover 26 which is shown in FIGS. 1 and 2. The cover 26 is connected to the housing 2 by means of screws 35. When the cover 26 is removed, the inner chamber 3 is therefore accessible.

The fastening element 13 and the other elements situated in the inner chamber 3 will now be explained in greater detail with reference to FIGS. 3 and 4.

Figure 6:
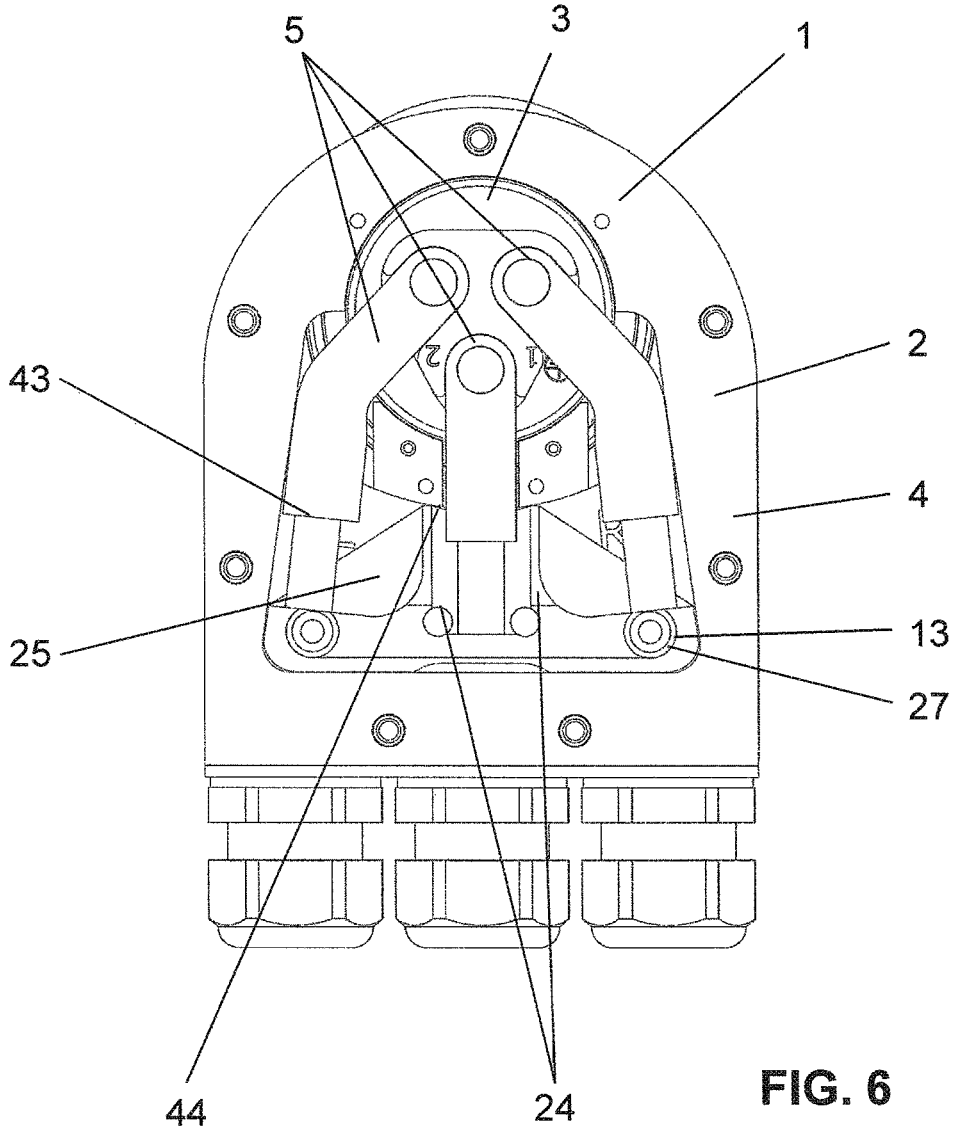
FIG. 6 shows a top view of the connection device according to one of the preceding figures.

The fastening element 13 is mounted entirely in the inner chamber 3 of the electrical connection device 1 so as to be movable from a fastening position and into a release position. The fastening element 13 is mounted, so as to be movable relative to the housing, in a guide 27 which is situated on the housing 2 or in a guide provided through the housing. In this case, the guide 27 is situated in the inner chamber 3 of the housing 2 and, in the present embodiment, essentially consists of the rounding in the area of the corner of the inner chamber 3. In the embodiment shown, as is shown in FIG. 6, an additional guide 44 is provided between the fastening element 13 and the housing 2. The additional guide 44 is provided here by webs 24, 25 of the fastening element 13 and a wall 45 of the housing 2. The wall 45 is concavely rounded here.

The connecting portions 6, 7 and 8 can have various designs in respect of their mechanical structure. In the present embodiment, the front region of the connecting portions 6, 7 and 8 has a cylindrical shape having a central axis M2. The connecting portions 6, 7 and 8, as well as the fastening element, are situated in the inner chamber 3 of the housing 2. The connecting portions 6, 7 and 8 are accessible from the outside via the connection openings 9, 10 and 11 in the wall 4. In the embodiment shown, a sealing element in the form of a sealing nut 41 is provided for each connection opening 9, 10 and 11. By means of this sealing nut 41, the connection opening 9, 10 and 11 can be provided with a seal when the external element 12 is inserted.

The connecting portions 6, 7 and 8 of the electrical components 5 are cylindrical in this case, as described. Adjoining the cylindrical portion is a rectangular cross section which is then connected to other electrical components in the inner chamber 3. For this purpose, the electrical components 5 comprise a further connecting portion 28.

The design of the fastening element 13 will now be described in greater detail with reference to the exploded representation in FIG. 4. Said stop element 14, 15 and 16 is provided by a stop surface 17 on the fastening element 13 in each case. The stop surface 17 can act in different ways. For example, the stop surface 17 can be part of a recess and can provide the stop via the friction force acting between the external element and the stop surface 17. Alternatively, the stop surface 17 is oriented in such a way that said stop surface blocks the movement of the external element 12.

In the embodiment shown, the stop surface 17 is oriented at a right angle with respect to the central axis M2 of the connecting portions 6, 7 and 8 or with respect to the insertion direction E. The stop surface 17 in this case is directed towards the inner chamber 3 and provides a stop for the external element 12.

The fastening element 13 comprises at least two—three, in this case—recesses 42. Each of the recesses is partially or completely enclosed by one stop surface 17. The external elements 12 extend through the recesses 42 and cooperate with the stop surface 17, wherein a stop for the external element 12 is provided when the external element 12 is inserted.

In the present embodiment, the fastening element 13 is displaced relative to the inserted external elements 12, and the recess 42 encompasses the external element 12. The wall 43 delimiting the recess 42 extends into a groove 18 on the external element 12. Due to the interplay between the groove 18 and the stop surface 17, the external element 12 is prevented from moving against the insertion direction E. This is described in greater detail further below in association with FIGS. 5*a* to 5*d*.

In the embodiment shown, the recess 42 is an opening enclosed by the fastening element 13. The opening is entirely enclosed by the fastening element 13 in this case. Alternatively, the recess 42 can also extend from the outside into the fastening element 13 and have the shape of a slot. For example, with reference to FIG. 4, the slot could extend from the bottom into the fastening element 13, so that the recess is open toward the bottom.

The connecting portions 6, 7 and 8 are essentially cylindrical, as mentioned above. This means the connecting portions 6, 7 and 8 comprise a cylindrical area having a central axis M2, via which an electrical contact to the external element 12 can be provided. In the embodiment shown, the recess 42 comprises a region which cylindrically encloses a central axis M1. The cylindrical region is provided by the recess 42. The central axis M1 of the recess 42 is oriented parallel to the central axis M2 of the connecting portions 6, 7 and 8 in this case. In the fastening position, the two central axes M1, M2 are offset with respect to each other. In other words, the fastening element 13 moves relative to the connecting portions 6, 7 and 8 into the fastening position.

The connection of the electrical connection device 1 to an external element 12 will now be explained in greater detail with reference to FIGS. 5*a* to 5*d*.

The external element 12 is designed as a plug 30 in this case, which is electrically conductively connected to a cable 31. In this case, the plug 30 has a bushing opening 37 which is used for accommodating one of the connecting portions 6, 7 and 8. Instead of the bushing opening 37, the plug can also have the shape of a pin, wherein the connecting portions 6, 7 and 8 then provide the bushing opening 37. A contact lamination 32 is preferably situated between the connecting portions 6, 7 and 8 and the plug 30.

Figure 5A:
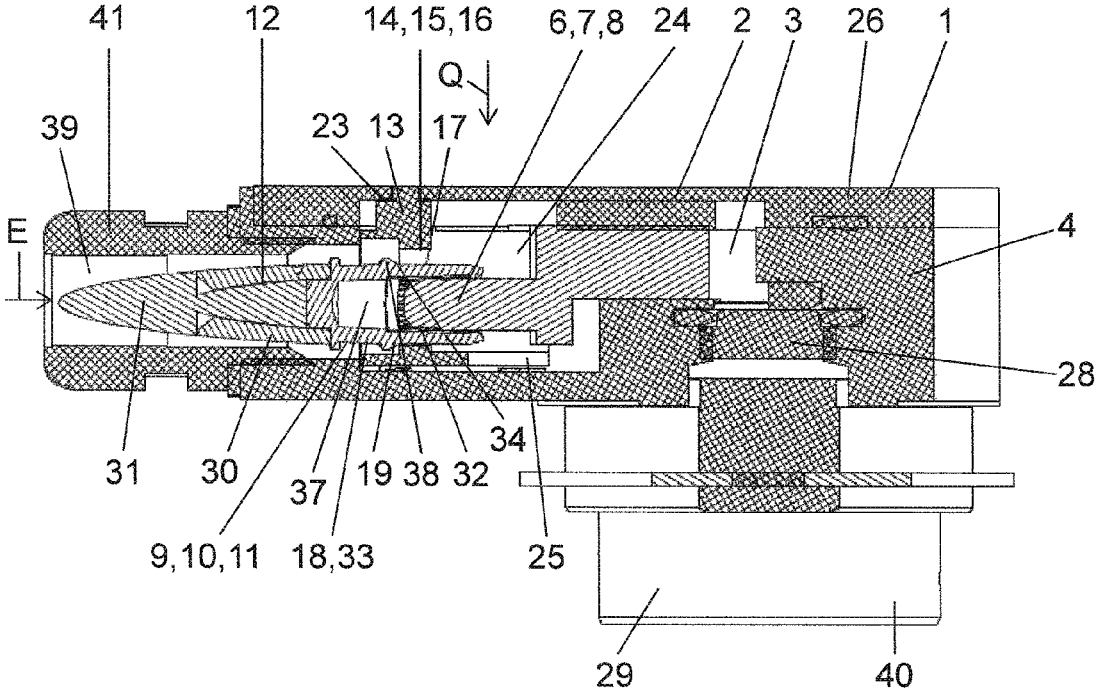
FIGS. 5*a*-5*d* show a sectional representation of the connection device during connection of an external element.
Figure 5B:
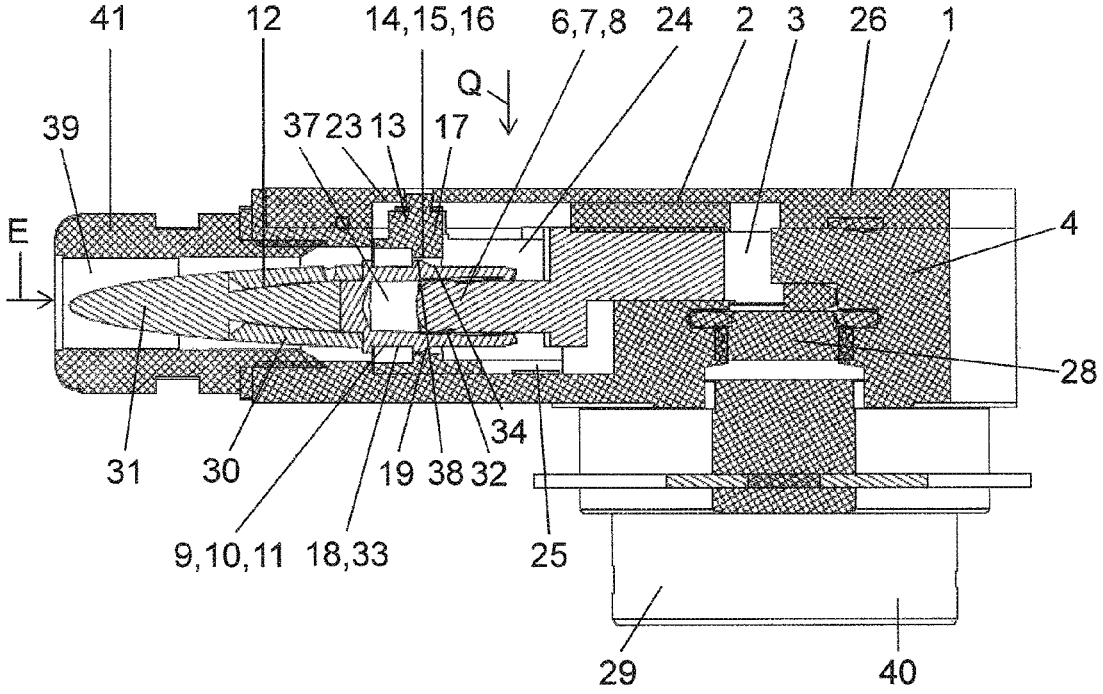

The situation in which the plug 30 is already in contact with the connecting portion 6, 7 and 8 will now be shown in greater detail in FIG. 5*a*. A protuberance 38, which is situated on the outside of the plug 30, is positioned close to the front of the recess 42. The protuberance 38 has a chamfered edge 34 on the front side thereof. When the plug 30 is inserted further into the inner chamber 3, the chamfered edge 34 comes into contact with the recess 42. As a result, the fastening element 13 is moved out of its fastening position, as shown in FIG. 5*a*, into the release position, as shown in FIG. 5*b*. The fastening element is therefore moved transversely to the insertion direction E. This direction is indicated with the reference character Q. The plug 30 is then slid further into the inner chamber and, in FIG. 5*c*, the plug has reached its final position. The path for the fastening element 13 from the release position and into the fastening position is now free again, because the protuberance 38 lies behind the recess 42. The fastening element 13 then moves from its release position back into its fastening position and the recess 42 is moved relative to the fixed plug 30, and so the fastening element 13 enters the region of the protuberance 38 and, there, provides a stop for the protuberance 38 via the stop surface 17.

Figure 5C:
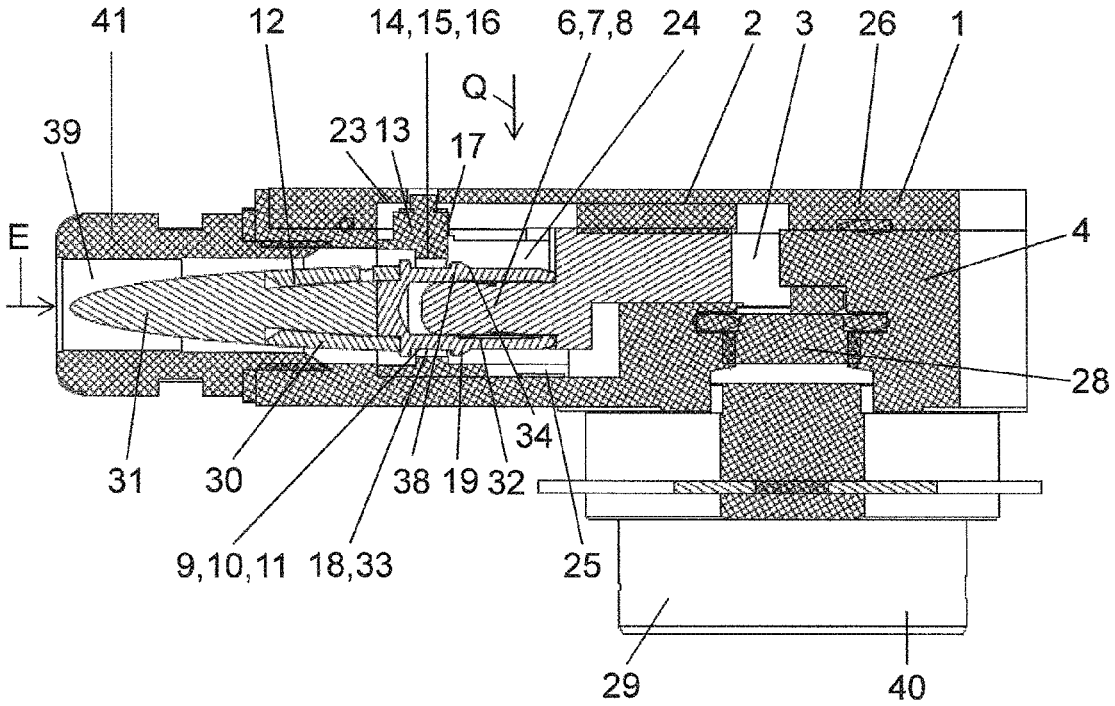
Figure 5D:
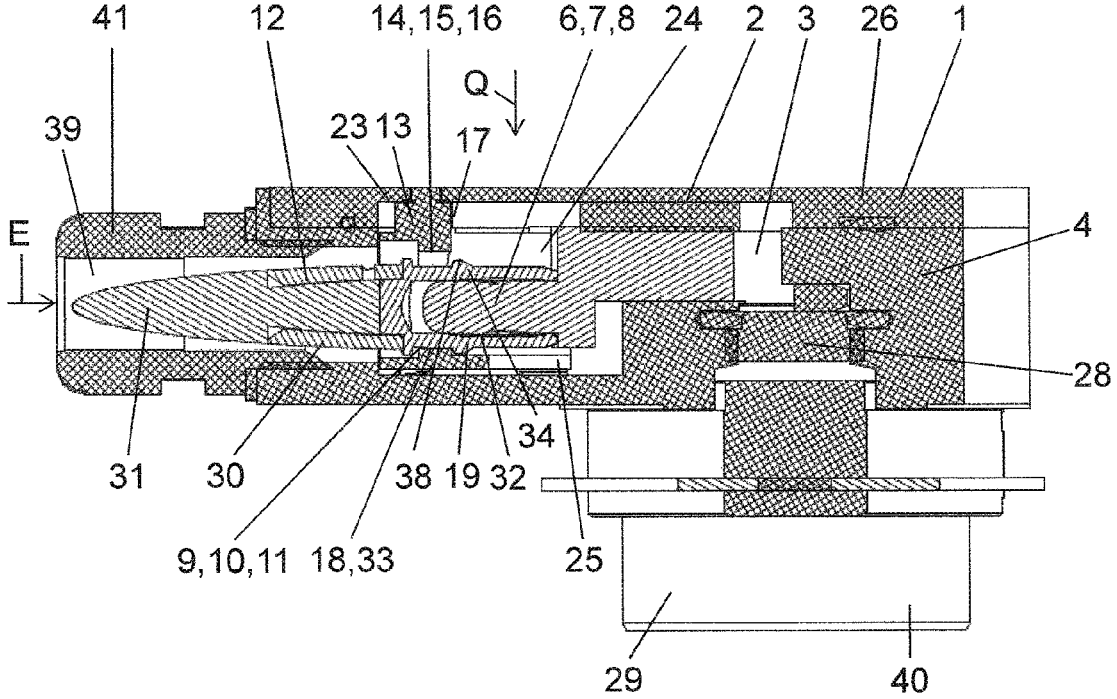

The fastening element 13 is now shown in its fastening position in FIG. 5*d*, and it is clearly evident that the plug 30 cannot be removed from the connection device 1 without the fastening element 13 having to be moved, therefore, from the fastening position, as shown in FIG. 5*d*, into the release position, as shown in FIGS. 5*b* and 5*c*. Only then is the protuberance 38 released by the stop surface 17 and the plug can be moved out of the inner chamber.

A return element 20 is provided for the return movement of the fastening element 13 from the release position and into the fastening position. In the present embodiment, two return elements 20 are present in the form of compression springs. These compression springs 20 press the fastening element 13 out of the release position and into the fastening position. In this case, the compression springs 20 are situated between the fastening element 13 and the bottom of the housing 2. The fastening element 13 is then pressed by the compression springs 20 against the cover 26. The spring force of the compression springs 20 must be overcome when the fastening element 13 moves from the fastening position and into the release position. The return element 20 can have a different design, however.

The fastening element 13 also comprises at least one actuating portion 21. In the present embodiment, the actuating portion 21 has the shape of a push-button which protrudes from the fastening element 13. The actuating portion 21 is a component of the fastening element 13. In this case, the actuating portion 21 extends through an opening 22 in the wall 4 and is accessible through this opening 22 through the wall 4. In the present embodiment, the opening 22 is situated in the cover 26 and the user who would like to disconnect the plug 30 from the electrical connection device 1 can move the fastening element 13 from the fastening position and into the release position via the actuating portions 21 which are accessible through the cover 26.

In the present embodiment, two actuating portions 21 are present, which are preferably actuated in combination with each other, so that the movement of the fastening element 13 takes place evenly.

A sealing element 23 is arranged between the wall 4—between the cover 26 in this case—in the region of the opening 22, and the actuating portion 21. The sealing element 23 rests against a shoulder on the actuating portion 21 in this case.

It is also readily apparent in FIG. 4 that the fastening element 13 comprises a web 24 between two adjacent stop elements 14, 15 and 16 in each case. A web 25, which forms the base for the webs 24, extends further in the same direction as the web 24. The webs 24, 25 are used essentially as a stiffening element for the fastening element 13 which is designed in the shape of a bar in this case.

As briefly explained above, a further connecting portion 28 is assigned to each of the connecting portions 6, 7 and 8. The further connecting portion 28 leads into the bushing side or the pin side of one plug 29 at this point. Alternatively, the further connecting portion 28 can be in connection to electrical parts, such as, for example, a printed circuit board, which are electrically conductively connected to the connecting portions 6, 7 and 8 in the inner chamber 3 of the housing 2. Other embodiments of the connecting portion 28 are also conceivable.

LIST OF REFERENCE NUMBERS

1 electrical connection device
2 housing
3 inner chamber
4 wall
5 electrical elements
6 first connecting portion
7 second connecting portion
8 third connecting portion
9 first connecting opening
10 second connecting opening
11 third connecting opening
12 external element
13 fastening element
14 first stop element
15 second stop element
16 third stop element
17 stop surface
18 groove
19 chamfered edge
20 return element
21 actuating portion
22 opening
23 sealing element
24 web
25 web
26 cover
27 guide
28 further connecting portion
29 plug
30 plug
31 cable
32 contact lamination
33 portion
34 chamfered edge

35 screws
37 bushing opening
38 protuberance
39 input side
40 output side
41 sealing nut
42 recesses
43 wall
44 guide
M1 central axis
M2 central axis
E insertion direction
Q transverse direction

The invention claimed is:

1. An electrical connection device, in particular in the form of a connecting box or a plug-in connector, comprising a housing having a wall delimiting an inner chamber, electrical components situated in the inner chamber and having at least two connecting portions, and at least two connecting openings passing through the wall, through which external elements connectable to the connecting portions can be routed into the inner chamber, wherein the connection device further comprises a mechanical fastening element having a number of stop elements which corresponds to the number of connecting portions, which stop elements provide a mechanical stop for the external elements, wherein said stop elements are provided, in each case, by a stop surface on the fastening element, by means of which stop surface the mechanical stop can be provided for the external element when the external element is inserted;

wherein the fastening element comprises at least two recesses, wherein each of the recesses is partially or completely enclosed by one stop surface, and wherein one of the external elements can be routed through one recess in each case, and wherein the stop surface is located behind the recess relative to an insertion direction of the external element; and wherein the connecting portions are designed essentially as a cylinder having a central axis, wherein the fastening element is designed so as to be movable relative to the housing transversely to the central axis, and/or wherein the recess is designed to cylindrically enclose a central axis at least in sections or entirely, which central axis extends in parallel to the central axis of the connecting portion, wherein the central axes are offset with respect to each other.

2. The electrical connection device as claimed in claim 1, wherein all stop elements are arranged on one shared fastening element.

3. The electrical connection device as claimed in claim 1, wherein the recess comprises a chamfered edge and/or the external element comprises a chamfered edge which cooperates with the recess, in particular with its chamfered edge.

4. The electrical connection device as claimed in claim 1, wherein the fastening element can be moved from a fastening position and into a release position, wherein the connection device further comprises a return element which holds the fastening element in the fastening position and with which the fastening element can be automatically moved from the release position and into the fastening position.

5. The electrical connection device as claimed in claim 1, wherein the fastening element lies essentially entirely in the inner chamber.

6. The electrical connection device as claimed in claim 1, wherein the fastening element comprises at least one actuating portion which is accessible from outside the inner chamber through an opening in the wall.

7. The electrical connection device as claimed in claim 6, wherein a sealing element is arranged between the wall, in a region of the opening, and the at least one actuating portion.

8. The electrical connection device as claimed in claim 1, wherein the fastening element is designed in a shape of a bar and comprises webs which extend away from the fastening element and increase the stiffness of the fastening element.

9. The electrical connection device as claimed in claim 1, wherein the number of connecting openings corresponds to the number of connecting portions and/or the number of stop elements.

10. The electrical connection device as claimed in claim 1, wherein each of the electrical components comprises, in addition to said at least one connecting portion, at least one further connecting portion, wherein the further connecting portion forms a bushing side or a pin side of a plug which extends through the wall, or wherein the further connecting portion is electrically conductively connected to electrical parts, such as a printed circuit board, in the inner chamber of the housing.

11. An arrangement comprising an electrical connection device as claimed in claim 1 and comprising at least one external element to be connected to the electrical connection device, wherein the external element comprises a portion which cooperates with the stop element.

12. The arrangement as claimed in claim 11, wherein the external element comprises a plug portion having a cable which is electrically conductively connected to the plug portion, wherein the plug portion can be electrically conductively connected to the connecting portions, wherein the plug portion is designed as a bushing and the connecting portion is designed as a pin, or the plug portion is designed as a pin and the connecting portion is designed as a bushing, wherein an electrical contact can be established between the pin and the bushing, preferably via a contact lamella.

13. The arrangement as claimed in claim 12, wherein said portion, which cooperates with the stop element, is a protuberance or a groove which, in particular, is situated on the plug portion.

14. The arrangement as claimed in claim 13, wherein the fastening element is movable transversely to the insertion direction and, in the fastening position, the stop elements are situated relative to the protuberance or groove in such a way that a movement against the insertion direction is prevented.

15. The arrangement as claimed in claim 12, wherein the stop element is provided, in each case, by a stop surface on the fastening element, by means of which stop surface the stop can be provided for the external element when the external element is inserted, wherein the fastening element comprises at least two recesses, wherein each of the recesses is partially or completely enclosed by one stop surface, one of the external elements can be routed through one recess in each case, and the stop surface is located behind the recess relative to the insertion direction of the external element, wherein the connecting portions are designed essentially as a cylinder having a central axis, the fastening element is designed so as to be movable transversely to the central axis, and/or the recess is designed to cylindrically enclose a central axis at least in sections or entirely, which central axis extends in parallel to the central axis of the connecting portion, wherein the central axes are offset with respect to each other, and wherein, in the fastening position, the stop elements lie with the central axis of the cylindrical or partially cylindrical region offset with respect to the central axis of the plug portion.

16. An electrical connection device, in particular in the form of a connecting box or a plug-in connector, comprising a housing having a wall delimiting an inner chamber, electrical components situated in the inner chamber and having at least two connecting portions, and at least two connecting openings passing through the wall, through which external elements connectable to the connecting portions can be routed into the inner chamber, wherein the connection device further comprises a mechanical fastening element having a number of stop elements which corresponds to the number of connecting portions, which stop elements provide a mechanical stop for the external elements, and wherein the fastening element can be moved from a fastening position and into a release position, wherein the connection device further comprises a return element which holds the fastening element in the fastening position and with which the fastening element can be automatically moved from the release position and into the fastening position.

17. The electrical connection device as claimed in claim 16, wherein all stop elements are arranged on one shared fastening element and/or wherein said stop elements are provided, in each case, by a stop surface on the fastening element, by means of which stop surface the stop can be provided for the external element when the external element is inserted.

18. The electrical connection device as claimed in claim 17, wherein the fastening element comprises at least two recesses, wherein each of the recesses is partially or completely enclosed by one stop surface, and wherein one of the external elements can be routed through one recess in each case, and wherein the stop surface is located behind the recess relative to an insertion direction of the external element.

19. The electrical connection device as claimed in claim 18, wherein the connecting portions are designed essentially as a cylinder having a central axis, wherein the fastening element is designed so as to be movable relative to the housing transversely to the central axis, and/or wherein the recess is designed to cylindrically enclose a central axis at least in sections or entirely, which central axis extends in parallel to the central axis of the connecting portion, wherein the central axes are offset with respect to each other.

20. The electrical connection device as claimed in claim 16, wherein the fastening element is designed in a shape of a bar and comprises webs which extend away from the fastening element and increase the stiffness of the fastening element and/or wherein the number of connecting openings corresponds to the number of connecting portions and/or the number of stop elements.

21. The electrical connection device as claimed in claim 16, wherein each of the electrical components comprises, in addition to said at least one connecting portion, at least one further connecting portion, wherein the further connecting portion forms a bushing side or a pin side of a plug which extends through the wall, or wherein the further connecting portion is electrically conductively connected to electrical parts, such as a printed circuit board, in the inner chamber of the housing.

22. An arrangement comprising an electrical connection device as claimed in claim 16 and comprising at least one external element to be connected to the electrical connection device, wherein the external element comprises a portion which cooperates with the stop element.

23. The arrangement as claimed in claim 22, wherein the external element comprises a plug portion having a cable which is electrically conductively connected to the plug portion, wherein the plug portion can be electrically conductively connected to the connecting portions, wherein the plug portion is designed as a bushing and the connecting portion is designed as a pin, or the plug portion is designed as a pin and the connecting portion is designed as a bushing, wherein an electrical contact can be established between the pin and the bushing, preferably via a contact lamella, wherein said portion, which cooperates with the stop element, is a protuberance or a groove which, in particular, is situated on the plug portion.

24. The arrangement as claimed in claim 23, wherein the fastening element is movable transversely to the insertion direction and, in the fastening position, the stop elements are situated relative to the protuberance or groove in such a way that a movement against the insertion direction is prevented.

25. An electrical connection device, in particular in the form of a connecting box or a plug-in connector, comprising a housing having a wall delimiting an inner chamber, electrical components situated in the inner chamber and having at least two connecting portions, and at least two connecting openings passing through the wall, through which external elements connectable to the connecting portions can be routed into the inner chamber, wherein the connection device further comprises a mechanical fastening element having a number of stop elements which corresponds to the number of connecting portions, which stop elements provide a mechanical stop for the external elements, and wherein the fastening element is designed in a shape of a bar and comprises webs which extend away from the fastening element and increase the stiffness of the fastening element.

26. The electrical connection device as claimed in claim 25, wherein all stop elements are arranged on one shared fastening element and/or wherein said stop elements are provided, in each case, by a stop surface on the fastening element, by means of which stop surface the stop can be provided for the external element when the external element is inserted.

27. The electrical connection device as claimed in claim 26, wherein the fastening element comprises at least two recesses, wherein each of the recesses is partially or completely enclosed by one stop surface, and wherein one of the external elements can be routed through one recess in each case, and wherein the stop surface is located behind the recess relative to an insertion direction of the external element.

28. The electrical connection device as claimed in claim 27, wherein the connecting portions are designed essentially as a cylinder having a central axis, wherein the fastening element is designed so as to be movable relative to the housing transversely to the central axis, and/or wherein the recess is designed to cylindrically enclose a central axis at least in sections or entirely, which central axis extends in parallel to the central axis of the connecting portion, wherein the central axes are offset with respect to each other.

29. The electrical connection device as claimed in claim 25, wherein the fastening element can be moved from a fastening position and into a release position, wherein the connection device further comprises a return element which holds the fastening element in the fastening position and with which the fastening element can be automatically moved from the release position and into the fastening position.

30. The electrical connection device as claimed in claim 25, wherein the number of connecting openings corresponds to the number of connecting portions and/or the number of stop elements.

31. The electrical connection device as claimed in claim 25, wherein each of the electrical components comprises, in addition to said at least one connecting portion, at least one further connecting portion, wherein the further connecting portion forms a bushing side or a pin side of a plug which extends through the wall, or wherein the further connecting portion is electrically conductively connected to electrical parts, such as a printed circuit board, in the inner chamber of the housing.

32. An arrangement comprising an electrical connection device as claimed in claim 25 and comprising at least one external element to be connected to the electrical connection device, wherein the external element comprises a portion which cooperates with the stop element.

33. The arrangement as claimed in claim 32, wherein the external element comprises a plug portion having a cable which is electrically conductively connected to the plug portion, wherein the plug portion can be electrically conductively connected to the connecting portions, wherein the plug portion is designed as a bushing and the connecting portion is designed as a pin, or the plug portion is designed as a pin and the connecting portion is designed as a bushing, wherein an electrical contact can be established between the pin and the bushing, preferably via a contact lamella, wherein said portion, which cooperates with the stop element, is a protuberance or a groove which, in particular, is situated on the plug portion.

34. The arrangement as claimed in claim 33, wherein the fastening element is movable transversely to the insertion direction and, in the fastening position, the stop elements are situated relative to the protuberance or groove in such a way that a movement against the insertion direction is prevented.

35. An electrical connection device, in particular in the form of a connecting box or a plug-in connector, comprising a housing having a wall delimiting an inner chamber, electrical components situated in the inner chamber and having at least two connecting portions, and at least two connecting openings passing through the wall, through which external elements connectable to the connecting portions can be routed into the inner chamber, wherein the connection device further comprises a mechanical fastening element having a number of stop elements which corresponds to the number of connecting portions, which stop elements provide a mechanical stop for the external elements, and wherein each of the electrical components comprises, in addition to said at least one connecting portion, at least one further connecting portion, wherein the further connecting portion forms a bushing side or a pin side of a plug which extends through the wall, or wherein the further connecting portion is electrically conductively connected to electrical parts, such as a printed circuit board, in the inner chamber of the housing.

36. The electrical connection device as claimed in claim 35, wherein all stop elements are arranged on one shared fastening element and/or wherein said stop elements are provided, in each case, by a stop surface on the fastening element, by means of which stop surface the stop can be provided for the external element when the external element is inserted.

37. The electrical connection device as claimed in claim 36, wherein the fastening element comprises at least two recesses, wherein each of the recesses is partially or completely enclosed by one stop surface, and wherein one of the external elements can be routed through one recess in each case, and wherein the stop surface is located behind the recess relative to an insertion direction of the external element.

38. The electrical connection device as claimed in claim 37, wherein the connecting portions are designed essentially as a cylinder having a central axis, wherein the fastening element is designed so as to be movable relative to the housing transversely to the central axis, and/or wherein the recess is designed to cylindrically enclose a central axis at least in sections or entirely, which central axis extends in parallel to the central axis of the connecting portion, wherein the central axes are offset with respect to each other.

39. The electrical connection device as claimed in claim 35, wherein the fastening element can be moved from a fastening position and into a release position, wherein the connection device further comprises a return element which holds the fastening element in the fastening position and with which the fastening element can be automatically moved from the release position and into the fastening position.

40. The electrical connection device as claimed in claim 35, wherein the fastening element is designed in a shape of a bar and comprises webs which extend away from the fastening element and increase the stiffness of the fastening element.

41. The electrical connection device as claimed in claim 35, wherein the number of connecting openings corresponds to the number of connecting portions and/or the number of stop elements.

42. An arrangement comprising an electrical connection device as claimed in claim 35 and comprising at least one external element to be connected to the electrical connection device, wherein the external element comprises a portion which cooperates with the stop element.

43. The arrangement as claimed in claim 42, wherein the external element comprises a plug portion having a cable which is electrically conductively connected to the plug portion, wherein the plug portion can be electrically conductively connected to the connecting portions, wherein the plug portion is designed as a bushing and the connecting portion is designed as a pin, or the plug portion is designed as a pin and the connecting portion is designed as a bushing, wherein an electrical contact can be established between the pin and the bushing, preferably via a contact lamella, wherein said portion, which cooperates with the stop element, is a protuberance or a groove which, in particular, is situated on the plug portion.

44. The arrangement as claimed in claim 43, wherein the fastening element is movable transversely to the insertion direction and, in the fastening position, the stop elements are situated relative to the protuberance or groove in such a way that a movement against the insertion direction is prevented.

45. An arrangement comprising an electrical connection device with a housing having a wall delimiting an inner chamber, electrical components situated in the inner chamber and having at least two connecting portions, at least two connecting openings passing through the wall, through which external elements connectable to the connecting portions can be routed into the inner chamber, and a mechanical fastening element having a number of stop elements which corresponds to the number of connecting portions, which stop elements provide a mechanical stop for the external elements; and at least one external element to be connected to the electrical connection device, wherein the external element comprises a portion which cooperates with the stop element, and wherein the external element comprises a plug portion having a cable which is electrically conductively connected to the plug portion, wherein the plug portion can be electrically conductively connected to the connecting portions, wherein the plug portion is designed as a bushing and the connecting portion is designed as a pin, or the plug portion is designed as a pin and the connecting portion is designed as a bushing, wherein an electrical contact can be established between the pin and the bushing, preferably via a contact lamella.

46. The arrangement as claimed in claim 45, wherein the fastening element is movable transversely to the insertion direction and, in the fastening position, the stop elements are situated relative to the protuberance or groove in such a way that a movement against the insertion direction is prevented.

* * * * *